US008006659B2

(12) United States Patent
Ezaki

(10) Patent No.: US 8,006,659 B2
(45) Date of Patent: Aug. 30, 2011

(54) INTERNAL COMBUSTION ENGINE WITH VARIABLE VALVE MECHANISM

(75) Inventor: Shuichi Ezaki, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 344 days.

(21) Appl. No.: 12/377,390

(22) PCT Filed: Dec. 4, 2007

(86) PCT No.: PCT/JP2007/073397

§ 371 (c)(1),
(2), (4) Date: Feb. 13, 2009

(87) PCT Pub. No.: WO2008/075556

PCT Pub. Date: Jun. 26, 2008

(65) Prior Publication Data

US 2010/0224150 A1 Sep. 9, 2010

(30) Foreign Application Priority Data

Dec. 18, 2006 (JP) ..... 2006-340342

(51) Int. Cl.
*F01L 1/34* (2006.01)

(52) U.S. Cl. ..... 123/90.16; 123/90.39; 123/90.15

(58) Field of Classification Search ..... 123/90.15, 123/90.16, 90.39; 74/569
See application file for complete search history.

(56) References Cited

U.S. PATENT DOCUMENTS 5,080,054 A * 1/1992 Nakamura ..... 123/90.16

FOREIGN PATENT DOCUMENTS

| | | |
|---|---|---|
| JP | 6 221123 | 8/1994 |
| JP | 6 299825 | 10/1994 |
| JP | 9 228808 | 9/1997 |
| JP | 2003 239712 | 8/2003 |
| JP | 2006 283700 | 10/2006 |
| JP | 2006 307786 | 11/2006 |

* cited by examiner

*Primary Examiner* — Zelalem Eshete
(74) *Attorney, Agent, or Firm* — Oblon, Spivak, McClelland, Maier & Neustadt, L.L.P.

(57) ABSTRACT

An internal combustion engine including a variable valve mechanism that can avoid an unnecessary friction increase while preventing a hydraulic lash adjuster from pumping up. When a first engine speed is a critical rotation speed at which the inertia force of the variable valve mechanism exceeds the maximum load on a lost motion spring and a second engine speed is a critical rotation speed at which the inertia force of a valve and rocker arm exceeds the maximum load on a valve spring, the maximum loads are set such that the first engine speed is lower than the second engine speed.

4 Claims, 6 Drawing Sheets

INTERNAL COMBUSTION ENGINE WITH VARIABLE VALVE MECHANISM

TECHNICAL FIELD

The present invention relates to an internal combustion engine with a variable valve mechanism that is capable of mechanically changing the operating angle and lift amount of a valve.

BACKGROUND ART

A known device disclosed, for instance, in Patent Document 1 has a variable valve mechanism that is capable of mechanically changing the operating angle and lift amount of a valve in accordance with the operating status of an internal combustion engine. The variable valve mechanism of this device is positioned between a cam and a rocker arm.

Patent Document 1: JP-A-2003-239712
Patent Document 2: JP-A-1994-221123
Patent Document 3: JP-A-1997-228808
Patent Document 4: Japanese Patent No. 2503932

DISCLOSURE OF INVENTION

Problems to be Solved by the Invention

The rocker arm is supported by a valve and a hydraulic lash adjuster (HLA). Therefore, according to the energized force of the valve spring and the hydraulic lash adjuster press the rocker arm against the variable valve mechanism.

However, when the internal combustion engine rotates at a high speed, a valve operating system including, for instance, the variable valve mechanism, rocker arm, and valve operates at a high speed. Therefore, the inertia force acting on the valve operating system increases. An increase in the inertia force may separate the variable valve mechanism and rocker arm from each other. In this instance, the hydraulic lash adjuster instantaneously extends to bring the rocker arm and variable valve mechanism back into contact with each other. In other words, the hydraulic lash adjuster pumps up. As a result, a valve closing failure may occur to prevent the valve from fully closing.

Further, when the maximum spring load is set high, an unnecessary friction increase may occur in the valve operating system, thereby degrading fuel efficiency and decreasing the wear resistance of component parts.

The present invention has been made to solve the above problems. An object of the present invention is to provide an internal combustion engine with a variable valve mechanism that can prevent a hydraulic lash adjuster from pumping up and avoid an unnecessary friction increase.

ADVANTAGES OF THE INVENTION

Means for Solving the Problem

First aspect of the present invention is an internal combustion engine with a mechanical variable valve mechanism that is positioned between a drive cam and a rocker arm, which is supported by a hydraulic lash adjuster and a valve, the internal combustion engine comprising:

a lost motion spring which imposes a load so as to press the variable valve mechanism against the drive cam; and a valve spring which imposes a load so as to press the rocker arm against the variable valve mechanism;

wherein, when a first engine speed is a critical engine speed at which the inertia force of the variable valve mechanism exceeds the maximum load on the lost motion spring and a second engine speed is a critical engine speed at which the inertia forces of the valve and the rocker arm exceed the maximum load on the valve spring, the maximum loads of the lost motion spring and the valve spring are set such that the first engine speed is lower than the second engine speed.

Second aspect of the present invention is the internal combustion engine according to the first aspect, wherein the maximum loads on the lost motion spring and the valve spring are set such that an engine speed at which the valve bounces is a maximum permissible instantaneous rotation speed, which is the instantaneously permissible maximum engine speed.

Third aspect of the present invention is the internal combustion engine according to the first or second aspects, wherein the maximum load on the valve spring is set such that the second engine speed is a long-term guaranteed rotation speed, which represents the maximum rotation speed that can be achieved by the internal combustion engine alone after a fuel cut.

Effects of the Invention

According to a first aspect of the present invention, a first engine speed at which the inertia force of the variable valve mechanism exceeds the maximum load on the lost motion spring is set lower than a second engine speed at which the inertia forces of the valve and rocker arm exceed the maximum load on the valve spring. Therefore, the drive cam is allowed to separate from the variable valve mechanism before the rocker arm separates from the variable valve mechanism.

When the rocker arm separates from the variable valve mechanism, the hydraulic lash adjuster may pump up, thereby causing a valve closing failure. However, the first aspect of the present invention prevents the hydraulic lash adjuster from pumping up while permitting a jump to occur after the drive cam separates from the variable valve mechanism. This makes it possible to avoid a valve closing failure and prevent internal combustion engine performance deterioration.

Further, even when the maximum load on the valve spring is set so as to avoid separation between the rocker arm and variable valve mechanism, the first aspect of the present invention selects a low maximum load on the lost motion spring so as to permit separation between the variable valve mechanism and drive cam. Therefore, an unnecessary friction increase in the variable valve mechanism can be suppressed. This makes it possible to minimize fuel efficiency degradation and decrease in the wear resistance of variable valve mechanism components.

A second aspect of the present invention sets the maximum loads on the lost motion spring and valve spring such that the engine speed at which a bounce occurs is regarded as the maximum permissible instantaneous rotation speed. Therefore, the occurrence of a bounce can be substantially inhibited. Further, the maximum loads on the springs are set lower than when the engine speed at which a bounce occurs is set higher than the maximum permissible instantaneous rotation speed. This makes it possible to suppress an unnecessary friction increase in the variable valve mechanism.

A third aspect of the present invention sets the maximum load on the valve spring such that the critical engine speed (second engine speed) at which the inertia forces of the valve and rocker arm exceed the maximum load on the valve spring is regarded as a long-term guaranteed rotation speed. This inhibits the rocker arm from separating from the variable valve mechanism and prevents the hydraulic lash adjuster from pumping up until the long-term guaranteed rotation speed is reached. Therefore, a valve closing failure is avoided up to the long-term guaranteed rotation speed. Consequently, it is possible to avoid internal combustion engine performance deterioration.

DESCRIPTION OF REFERENCE CHARACTERS

Figure 1:
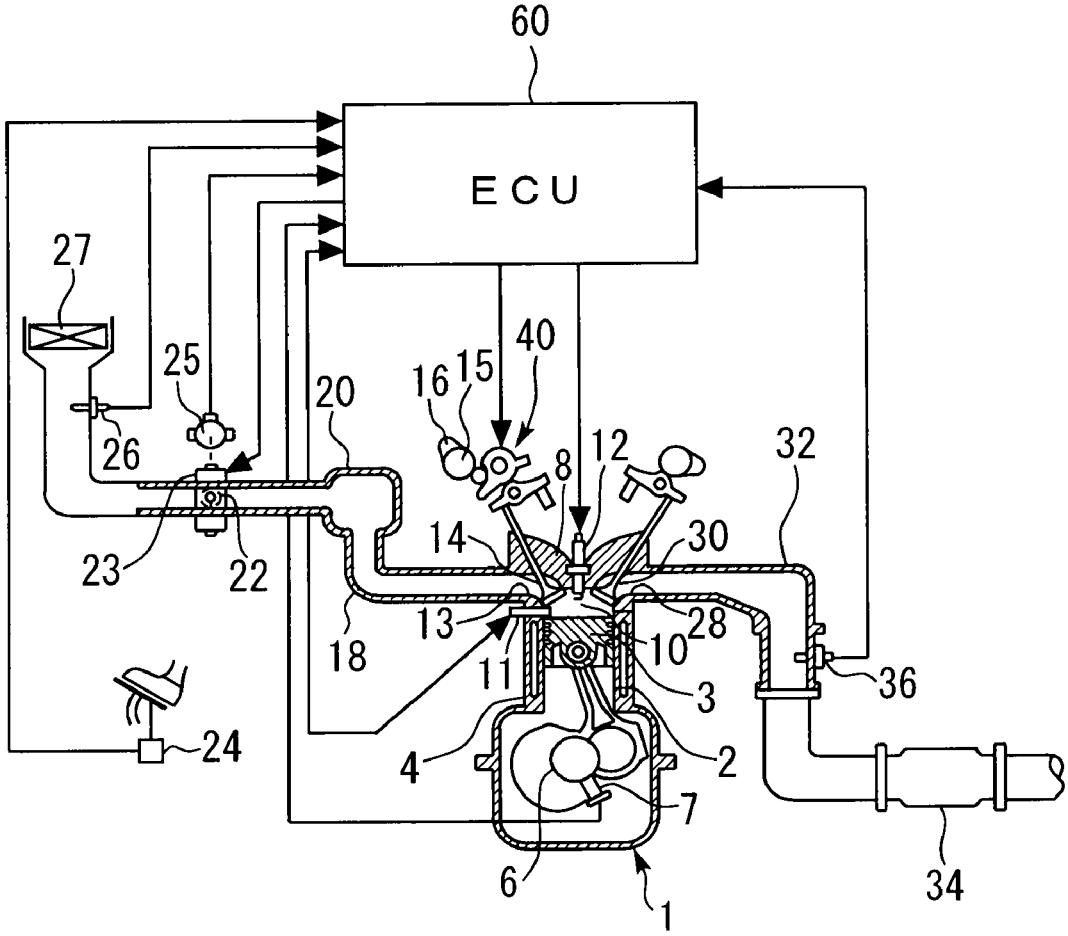
FIG. 1 is a diagram illustrating the overall configuration of a system according to an embodiment of the present invention.

1 internal combustion engine
7 crank angle sensor
14 intake valve
14*b* valve spring
16 intake cam
40 variable valve mechanism
41 control shaft
50 oscillation arm
52 cam roller
55 lost motion spring
56 rocker arm
57 rocker roller
58 hydraulic lash adjuster
60 ECU

BEST MODE FOR CARRYING OUT THE INVENTION

An embodiment of the present invention will now be described with reference to the accompanying drawings. Like elements in the drawings are assigned the same reference numerals and will not be further discussed.

[Description of System Configuration]

FIG. 1 is a diagram illustrating the overall configuration of a system according to an embodiment of the present invention. The system according to the present embodiment includes an internal combustion engine 1. The internal combustion engine 1 includes a plurality of cylinders 2. FIG. 1 shows only one of the cylinders.

The internal combustion engine 1 also includes a cylinder block 4, which contains a piston 3. The piston 3 is connected to a crankshaft 6 through a crank mechanism. A crank angle sensor 7 is installed near the crankshaft 6. The crank angle sensor 7 is configured to detect the rotation angle (crank angle or CA) of the crankshaft 6.

A cylinder head 8 is attached to the top of the cylinder block 4. The space between the upper surface of the piston 3 and the cylinder head 8 forms a combustion chamber 10. The cylinder head 8 includes an injector 11, which directly injects fuel into the combustion chamber 10. The cylinder head 8 also includes an ignition plug 12, which ignites an air-fuel mixture in the combustion chamber 10.

The cylinder head 8 has an intake port 13 that communicates with the combustion chamber 10. An intake valve 14 is mounted on the joint between the intake port 13 and combustion chamber 10. The system according to the present embodiment includes two of the intake valves 14 (see FIG. 2), which correlate to two of the intake ports 13 provided for each cylinder.

A mechanical variable valve mechanism 40 is installed between an intake valve 14 and an intake cam 16, which is mounted on an intake camshaft 15. This variable valve mechanism 40, which will be described later in detail, is capable of mechanically changing the valve opening characteristics of the intake valve 14. More specifically, the variable valve mechanism 40 is configured to continuously vary the interlock between the rotary motion of the intake cam 16 and the oscillating motion of a rocker arm 56, which will be described later. The intake camshaft 15 can be rotationally driven by transmitting the driving force of the crankshaft 6 to it.

An intake path 18 is connected to the intake port 13. A surge tank 20 is installed in the middle of the intake path 18. A throttle valve 22 is installed upstream of the surge tank 20. The throttle valve 22 is an electronically controlled valve that is driven by a throttle motor 23. The throttle valve 22 is driven in accordance with an accelerator opening angle AA that is detected by an accelerator opening sensor 24. A throttle opening sensor 25 is installed near the throttle valve 22 to detect a throttle opening angle TA.

An air flow meter 26 is installed upstream of the throttle valve 22. The air flow meter 26 is configured to detect an intake air amount Ga. An air cleaner 27 is installed upstream of the air flow meter 26.

The cylinder head 8 also has an exhaust port 28 that communicates with the combustion chamber 10. An exhaust valve 30 is mounted on the joint between the exhaust port 28 and combustion chamber 10. The exhaust port 28 is connected to an exhaust path 32. A catalyst 34 is installed in the exhaust path 32 to purify exhaust gas. An air-fuel ratio sensor 36 is installed upstream of the catalyst 34 to detect an exhaust air-fuel ratio.

The system according to the present embodiment also includes an ECU (Electronic Control Unit) 60, which serves as a control device. The output end of the ECU 60 is connected, for instance, to the injector 11, ignition plug 12, throttle motor 23, and variable valve mechanism 40. The input end of the ECU 60 is connected, for instance, to the crank angle sensor 7, accelerator opening sensor 24, throttle opening sensor 25, air flow meter 26, and air-fuel ratio sensor 36. In accordance with an output from each sensor, the ECU 60 exercises, for instance, fuel injection control and ignition timing control for overall control over the internal combustion engine.

Further, the ECU 60 calculates an engine speed NE in accordance with an output from the crank angle sensor 7. Moreover, the ECU 60 calculates a load KL imposed on the internal combustion engine 1 in accordance, for instance, with the accelerator opening angle AA and throttle opening angle TA. In addition, the ECU 60 exercises control to continuously vary the operating angle and lift amount of the intake valve 14 by controlling the position of a control shaft 41 in accordance with the operating status (NE and KL) of the internal combustion engine 1.

[Configuration of Variable Valve Mechanism]

Figure 2:
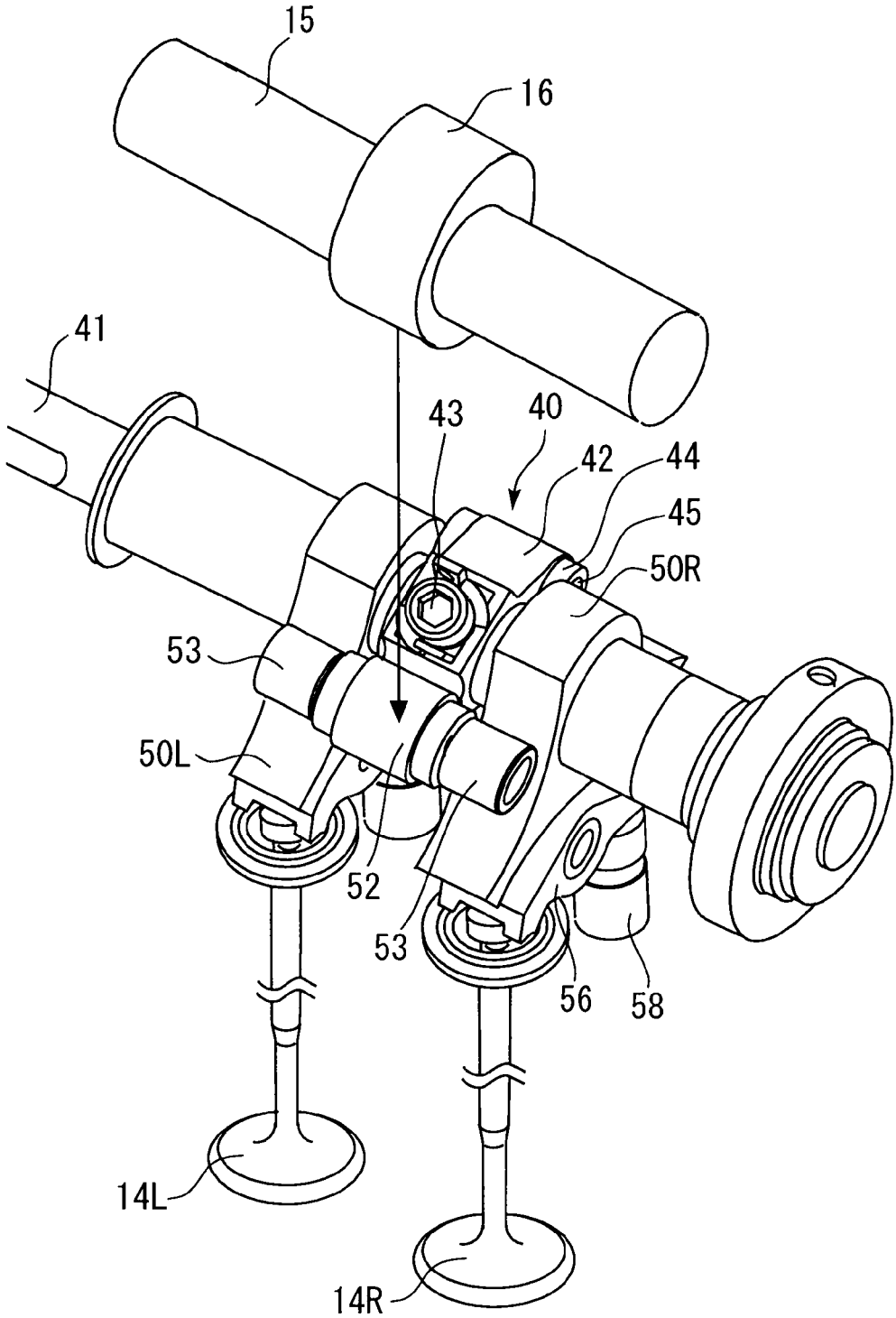
FIG. 2 is a perspective view illustrating the configuration of the variable valve mechanism 40 shown in FIG. 1.
Figure 3:
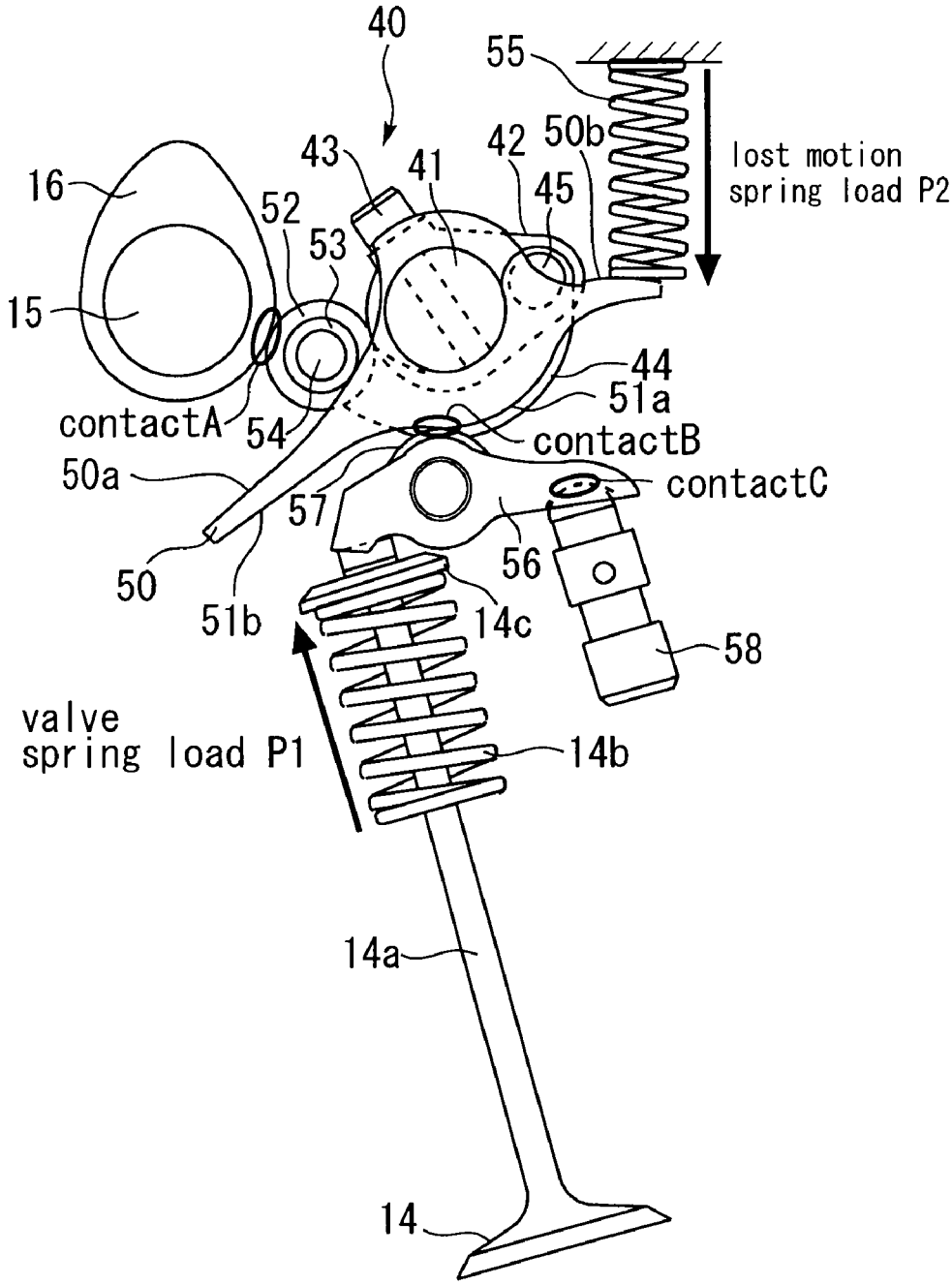
FIG. 3 is a side view of the variable valve mechanism 40 shown in FIG. 2, as viewed from the axial direction of the intake camshaft 15.

FIG. 2 is a perspective view illustrating the configuration of the variable valve mechanism 40 shown in FIG. 1. FIG. 3 is a side view of the variable valve mechanism 40 shown in FIG. 2, as viewed from the axial direction of the intake camshaft 15.

As shown in FIG. 2, two intake valves 14L and 14R are arranged bilaterally symmetrical with respect to the intake cam 16, which is a drive cam. The variable valve mechanism 40 is positioned between the intake cam 16 and intake valves 14L and 14R to interlock the lifting motions of the intake valves 14L and 14R with the rotary motion of the intake cam 16.

In this document and accompanying drawings, the symbols L and R, which respectively indicate left- and right-hand parts, may be omitted from the reference numerals representing the component parts of the variable valve mechanism 40, the intake valves 14L, and 14R, and other symmetrically arranged parts when it is not necessary to distinguish between them.

As shown in FIGS. 2 and 3, the variable valve mechanism 40 includes the control shaft 41. The control shaft 41 is positioned in parallel with the intake camshaft 15. This control shaft 41 is rotationally driven by a drive mechanism (not shown). The drive mechanism may be composed, for instance, of a worm wheel, which is fastened to the control shaft 41, a worm gear, which meshes with the worm wheel, and an electric motor having an output shaft to which the worm gear is fastened.

A control arm 42 is fastened to the control shaft 41 with a bolt 43. A pin 45 is used to mount an intermediate arm 44 on a protrusion of the control arm 42. The pin 45 is positioned eccentrically from the center of the control shaft 41. Therefore, the intermediate arm 44 is configured to oscillate about the pin 45. Rollers 52 and 53, which will be described later, are rotatably attached to the leading end of the intermediate arm 44.

Further, two oscillation arms 50L and 50R are swingably supported by the control shaft 41. Each oscillation arm 50 has a slide surface 50*a*, which faces the intake cam 16. The slide surface 50*a* is formed so as to be in contact with a second roller 53. The slide surface 50*a* is curved such that its distance from the intake cam 16 gradually decreases as the second roller 53 moves from the leading end of the oscillation arm 50 toward the axial center of the control shaft 41.

The oscillation arm 50 also has an oscillation cam surface 51, which is positioned opposite the slide surface 50*a*. The oscillation cam surface 51 is composed of a nonoperating surface 51*a* and an operating surface 51*b*. The nonoperating surface 51*a* is formed such that its distance from the swing center of the oscillation arm 50 is constant. The operating surface 51*b* is formed such that its distance from the axial center of the control shaft 41 increases with an increase in its distance from the nonoperating surface 51*a*.

A first roller (hereinafter also referred to as the "cam roller") 52 and the second roller 53 are positioned between the slide surface 50*a* and the circumferential surface of the intake cam 16. More specifically, the cam roller 52 is positioned in contact with the circumferential surface of the intake cam 16, whereas the second roller 53 is positioned in contact with the slide surface 50*a* of the oscillation arm 50.

The cam roller 52 and the second roller 53 are rotatably supported by a connecting shaft 54, which is fastened to the leading end of the intermediate arm 44. Since the intermediate arm 44 oscillates about the pin 45, these rollers 52 and 53 also oscillate along the slide surface 50*a* and the circumferential surface of the intake cam 16 while positioned at a fixed distance from the pin 45.

Further, a spring seat 50*b* is formed on the oscillation arm 50. One end of a lost motion spring 55 is engaged with the spring seat 50*b*. The other end of the lost motion spring 55 is fastened to a stationary part of the internal combustion engine 1. The lost motion spring 55 is a compression spring.

A load P2 on the lost motion spring 55 presses the slide surface 50*a* of the oscillation arm 50 against the second roller 53 and the cam roller 52 against the intake cam 16. The setting of a maximum load P2max on the lost motion spring 55 will be described later.

The rocker arm 56 is positioned below the oscillation arm 50. The rocker arm 56 is provided with a rocker roller 57, which faces the oscillation cam surface 51. The rocker roller 57 is rotatably mounted on the middle of the rocker arm 56. One end of the rocker arm 56 is supported by a valve shaft 14*a* for the valve 14. The other end of the rocker arm 56 is rotatably supported by a hydraulic lash adjuster 58. This allows the rocker arm 56 to rotationally move with the hydraulic lash adjuster 58 as a fulcrum point. The hydraulic lash adjuster 58 presses the rocker arm 56 upward to eliminate any clearance between the rocker roller 57 and oscillation cam surface 51.

The top of the valve shaft 14*a* is connected to a valve seat 14*c*. There is a valve spring 14*b* below the valve seat 14*c*. A load P1 on the valve spring 14*b* pushes the valve seat 14*c* upward, that is, in the valve closing direction and presses it against the rocker arm 56. This presses the rocker arm 56 upward, thereby pressing the rocker roller 57 against the oscillation cam surface 51 of the oscillation arm 50. The setting of a maximum load P1max on the valve spring 14*b* will be described later.

According to the configuration of the variable valve mechanism 40 described above, the pushing force of the intake cam 16 is transmitted to the slide surface 50*a* through the cam roller 52 and the second roller 53 as the intake cam 16 rotates. Consequently, when the contact between the oscillation cam surface 51 and rocker roller 57 extends from the nonoperating surface 51*a* to the operating surface 51*b*, the rocker arm 56 is pushed downward to open the intake valve 14.

Further, the variable valve mechanism 40 is configured such that a change in the rotation angle (rotational position) of the control shaft 41 changes the position of the second roller 53 on the slide surface 50*a* and correspondingly changes the oscillating range of the oscillation arm 50 during a valve lift.

Figure 4:
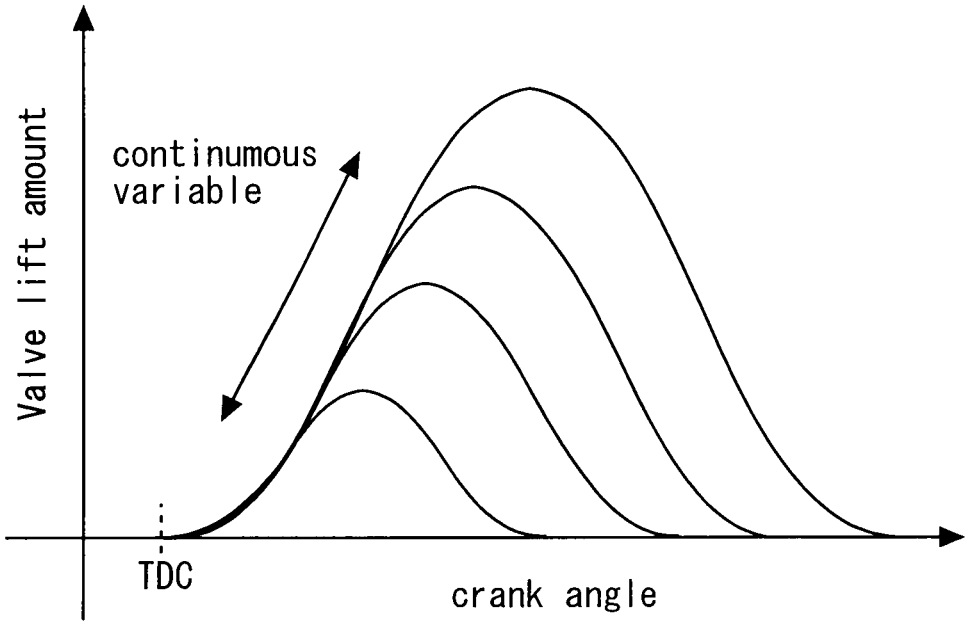
FIG. 4 is a view showing the continuous change in the operating angle and lift amount of the intake valve 14 that is implemented in the variable valve mechanism 40.

More specifically, when the control shaft 41 rotates counterclockwise as viewed in FIG. 3, the position of the second roller 53 on the slide surface 50*a* moves toward the leading end of the oscillation arm 50. The pushing force of the intake cam 16 is then transmitted. The rotational angle of the oscillation arm 50 required for the rocker arm 56 to actually start to be pressed after the oscillation arm 50 has started to oscillate increases with increase in the counterclockwise rotation of the control shaft 41 in FIG. 3. In other words, the counterclockwise rotation of the control shaft 41 as viewed in FIG. 3 decreases the operating angle and lift amount of the valve 14. Conversely, the clockwise rotation of the control shaft 41 increases the operating angle and lift amount of the valve 14. Controlling the position of the control shaft 41 as described above makes it possible to continuously vary the operating angle and lift amount of the intake valve 14, as shown in FIG. 4.

Features of the Embodiment

Meanwhile, the inventor of the present invention has found that the inertia force acting on the valve operating system containing the variable valve mechanism 40, rocker arm 56, and valve 14 is proportional to the square of the engine speed NE.

An inertia force F1 acting on the rocker arm 56, valve 14, and other valve operating system components below the variable valve mechanism 40 (these valve operating system components may be hereinafter collectively referred to as the "side valve-operating system") can be expressed by Equations (1) and (2) below. In Equations (1) and (2), the symbol "We" represents the equivalent mass [kg] of the valve side valve-operating system, whereas the symbol "A" represents the valve acceleration [mm/deg$^2$ (CAM)].

On the other hand, an inertia force F2 acting on the variable valve mechanism 40 in the valve operating system, that is, the inertia force F2 acting on the cam roller 52 of the variable valve mechanism 40 can be determined from the moment of inertia about the control shaft 41.

$$F1 = \frac{We}{1000} \times A \times \left[\frac{NE}{60 \times 2} \times 360\right]^2 \quad (1)$$

$$= 0.009 \times We \times A \times NE^2 \quad (2)$$

Figure 5:
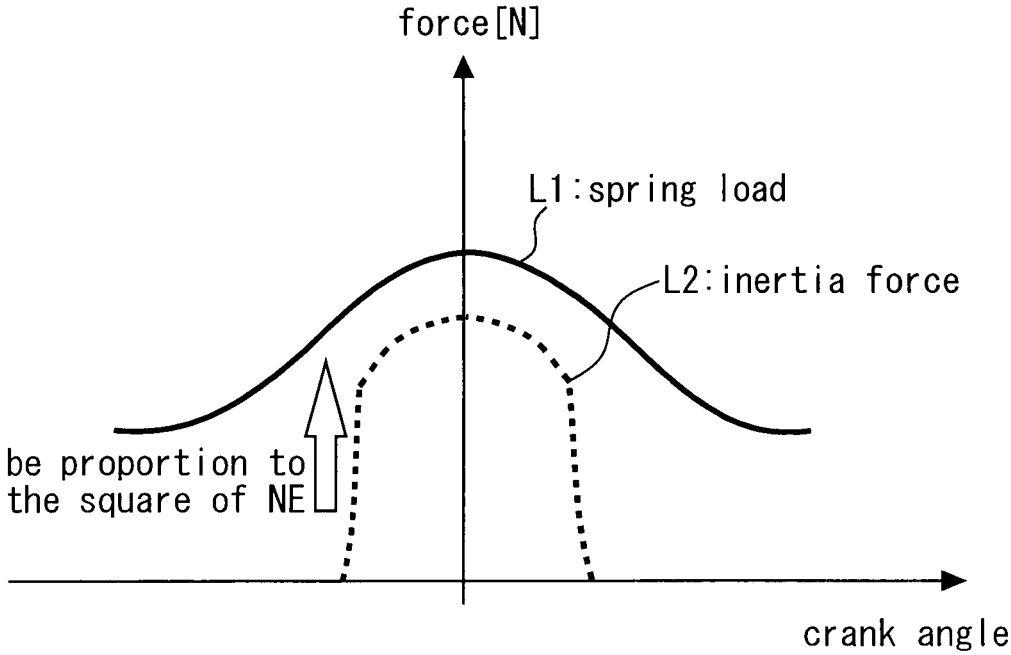
FIG. 5 is view showing one example that is spring load and inertia forces.
Figure 6:
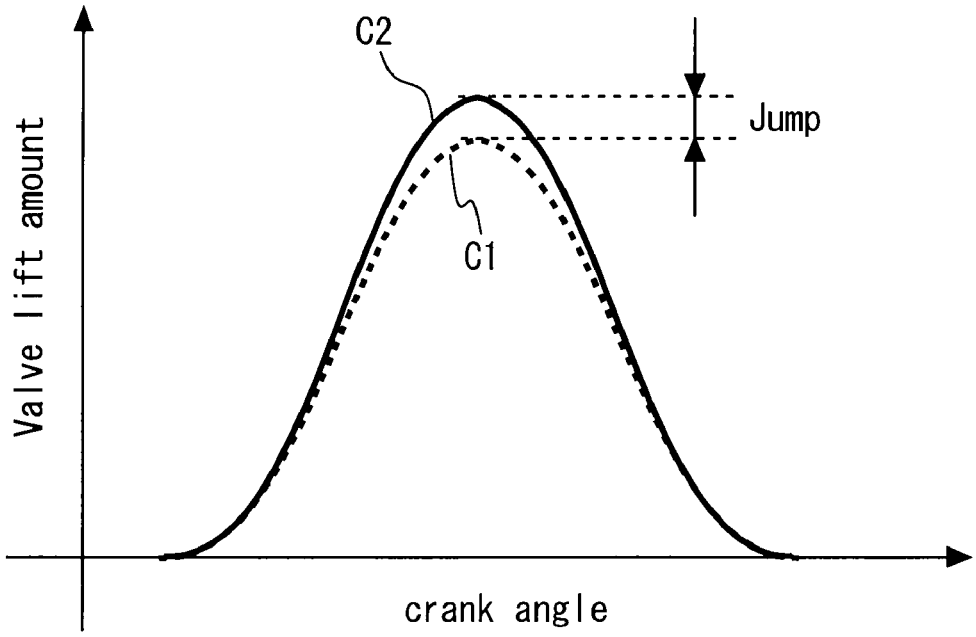
FIG. 6 is a view illustrating the jump causes in a high rotation speed.

At a low rotation speed, the operation speed of the valve operating system is not so high. At a low rotation speed, therefore, the inertia forces F1 and F2 of the valve operating system, which are indicated by a broken line L2, are smaller than spring loads P1 and P2, which are indicated by a solid line L1, as shown in FIG. 5. At such a low rotation speed, the contact A between the intake cam 16 and cam roller 52 and the contact B between the oscillation arm 50 and rocker roller 57, which are shown in FIG. 3, are both established (not spacing apart). Therefore, the valve lift curve at a low rotation speed, which is indicated by a broken line C1 in FIG. 6, agrees with a designed valve lift curve (hereinafter referred to as the "design lift curve"). Consequently, the intake valve 14 does not jump at a low rotation speed.

However, when the engine speed NE increases, the inertia forces acting on the valve operating system increase in proportion to the square of the engine speed NE (see FIG. 5). When the inertia forces exceed the spring loads, the aforementioned contacts A and B are lost. This causes the intake vale 14 to jump. The resulting valve lift characteristics differ from the valve lift characteristics C1 at a low rotation speed and look like a solid line C2 in FIG. 6.

When the engine speed NE further increases, the inertia forces also increase further. When the sum of the inertia forces is greater than the sum of the maximum spring loads by a predetermined value ΔF, a bounce occurs as indicated by a solid line C3 in FIG. 7. More specifically, the intake valve 14 jumps, becomes seated, and rebounds in sequence, as described in detail later. As an impact load caused by the bounce is transmitted to the cap portion of the intake valve 14, it is preferred that the occurrence of a bounce be avoided.

Figure 8:
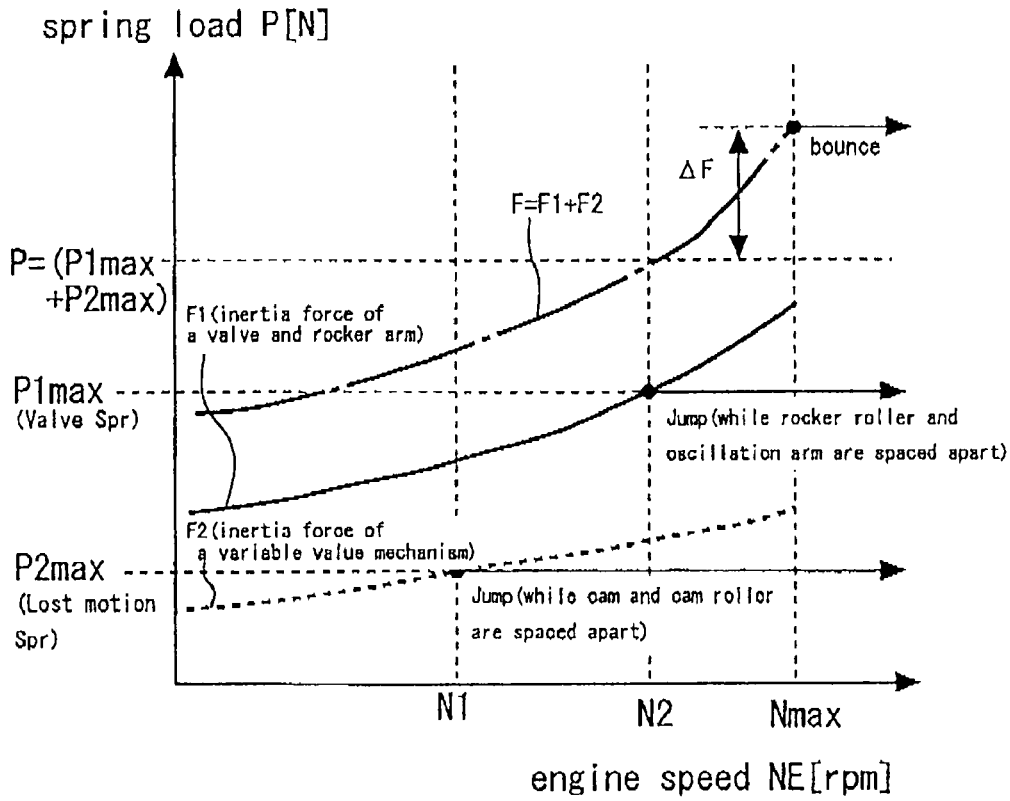
FIG. 8 illustrates how the present embodiment sets the maximum spring load P1max and P2max.

The present embodiment sets the maximum load P1max on the valve spring 14*b* and the maximum load P2max on the lost motion spring 55 in such a manner as described below. FIG. 8 illustrates how the present embodiment sets the maximum load P1max on the valve spring 14*b* and the maximum load P2max on the lost motion spring 55.

First of all, the method of setting the maximum load P1max on the valve spring 14*b* will be described.

Before the inertia force F1 of the intake valve 14 and rocker arm 56 exceeds the maximum load P1max on the valve spring 14*b*, the contact B is maintained between the rocker roller 57 and oscillation arm 50 shown in FIG. 3. When the inertia force F1 exceeds the maximum load P1max, breaking the contact B, contact C also breaks. In other words, when the rocker roller 57 and oscillation arm 50 separate from each other, the rocker arm 56 and hydraulic lash adjuster 58 also separate from each other. In that case, the hydraulic lash adjuster 58 exercises its check function and extends upward to press the rocker arm 56 upward. In other words, the hydraulic lash adjuster 58 pumps up.

When the contact B breaks, the intake valve 14 jumps. If the hydraulic lash adjuster 58 performs a leak-down operation to push the rocker arm 56 down to its original position before the intake valve 14 that has jumped becomes seated, no particular performance deterioration occurs in the internal combustion engine 1.

However, the time required for the leak-down (contraction) operation of the hydraulic lash adjuster 58 is longer than the time required for the check (pumping-up) operation of the hydraulic lash adjuster 58. The reason is that if the hydraulic lash adjuster 58 expands and contracts with excessive sensitivity, the position of the rocker arm 56 excessively changes to cause an excessive change in the lift amount of the intake valve 14. Thus, the hydraulic lash adjuster 58 that has pumped up does not complete its leak-down operation before the intake valve 14 that has jumped becomes seated.

Such being the case, the rotational fulcrum of the rocker arm 56 shifts upward, thereby causing a defective closure of the intake valve 14. When the defective closure of the intake valve 14 occurs, the amount of fresh air blown back to the intake path 18 increases. This decreases the amount of air taken into the combustion chamber 10, thereby decreasing the actual compression ratio. As a result, the performance of the internal combustion engine 1 deteriorates due, for instance, to a decreased compression end temperature and lowered engine output.

Thus, the present embodiment maintains (banned the separation) the contact B between the rocker roller 57 and oscillation arm 50 until a long-term guaranteed rotation speed N2 is reached in order to prevent the hydraulic lash adjuster 58 from pumping up as shown in FIG. 8. In other words, the present embodiment sets the maximum load P1max on the valve spring so that the inertia force F1 of the rocker arm 56 and valve 14 exceeds the maximum load P1max at the long-term guaranteed rotation speed N2. More specifically, a critical engine speed at which the inertia force F1 exceeds the maximum load P1max on the valve spring is regarded as the long-term guaranteed rotation speed N2.

The long-term guaranteed rotation speed N2 is the maximum engine speed that can be achieved by only the internal combustion engine 1 after a fuel cut. The long-term guaranteed rotation speed N2 is determined in light of, for example, an overshoot after a fuel cut in the red zone and variations in such a fuel cut. The long-term guaranteed rotation speed N2 is higher than the maximum output rotation speed (e.g., 6000 rpm) and 6500 rpm, for example.

The method of setting the maximum load P2max on the lost motion spring 55 will now be described. As is the case with the maximum load P1max on the valve spring, the maximum load P2max can be set such that the inertia force F2 of the cam roller 52 in the variable valve mechanism 40 exceeds the maximum load P2max on the lost motion spring at the long-term guaranteed rotation speed N2 as indicated by a comparative example shown in FIG. 9. The use of this setup method makes it possible to prevent breaking of the contact A between the intake cam 16 and cam roller 52 and as well as of the contact B up to the long-term guaranteed rotation speed N2.

Figure 7:
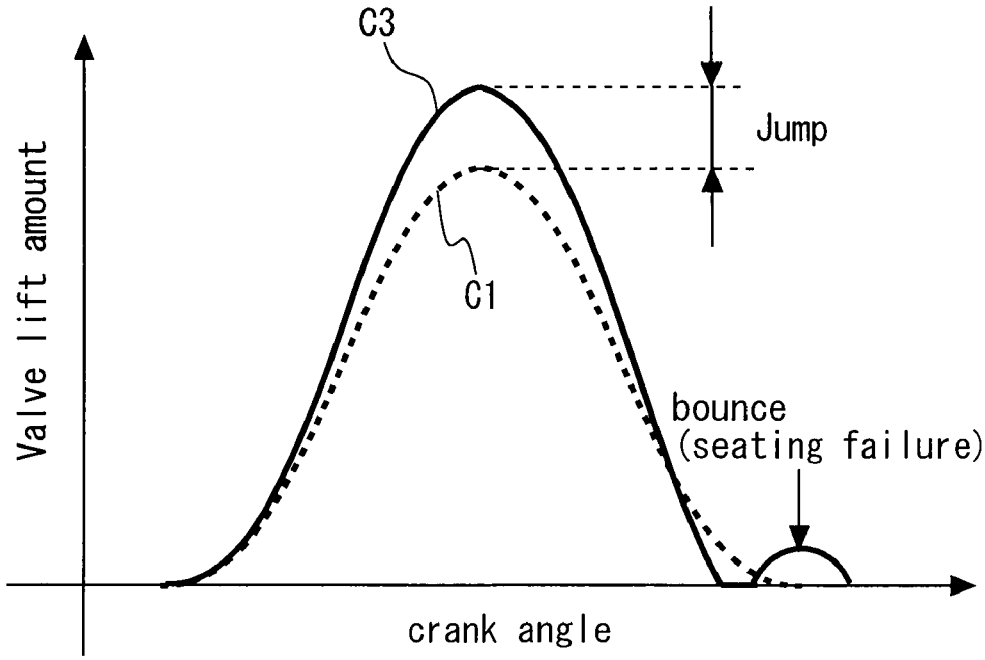
FIG. 7 is a view illustrating the jump causes in a high rotation speed.
Figure 9:
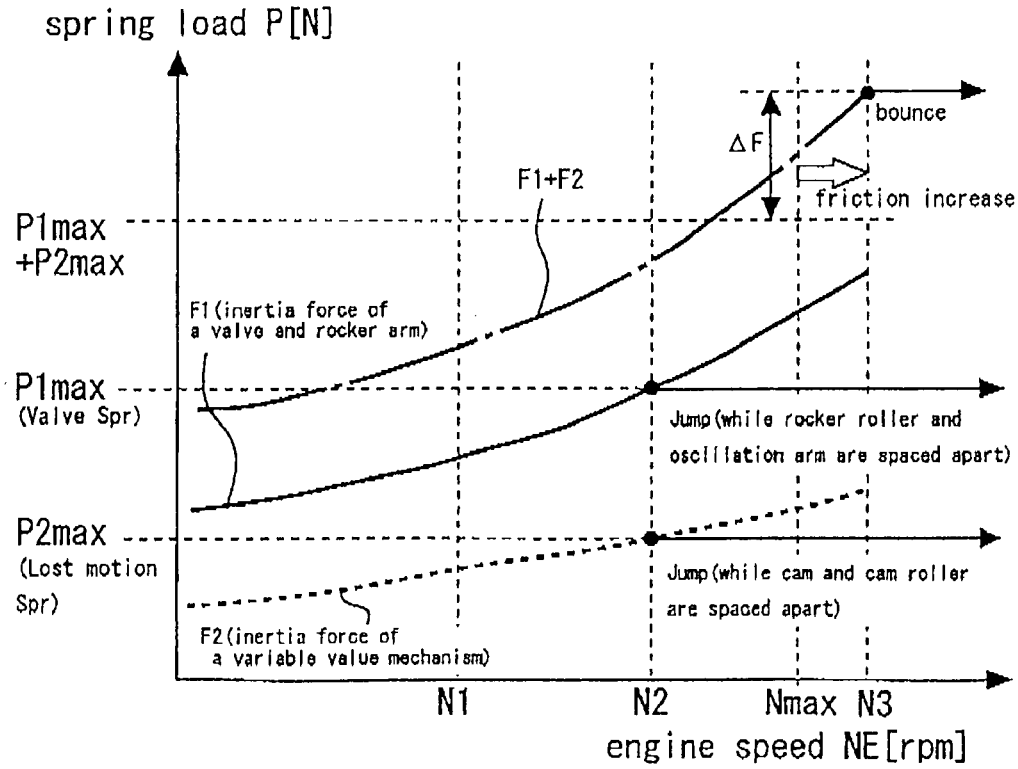
FIG. 9 is a view showing a comparative example for an embodiment of the present invention.

Meanwhile, the bounce shown in FIG. 7 occurs when the sum F (=F1+F2) of the two inertia forces F1 and F2 is greater than the sum P (=P1max+P2max) of the two spring maximum loads P1max and P2max by the predetermined value AF as indicated in FIG. 9. As shown in FIG. 9, therefore, when the two maximum loads P1max and P2max are set with reference to the long-term guaranteed rotation speed N2, a bounce occurs at an engine speed N3 higher than a maximum permissible instantaneous rotation speed Nmax. The maximum permissible instantaneous rotation speed Nmax is an engine speed that is not provided by the internal combustion engine 1 alone but momentarily achieved when the rotation speed increases due to a shift-down operation. For example, the maximum permissible instantaneous rotation speed Nmax is 6900 rpm.

In reality, however, a maximum achievable rotation speed is not higher than the maximum permissible instantaneous rotation speed Nmax; the engine speed N3 cannot be achieved. In the comparative example shown in FIG. 9, therefore, the sum P of the maximum loads is excessive because the occurrence of a bounce is excessively inhibited between the maximum permissible instantaneous rotation speed Nmax and engine speed N3 as indicated by an arrow in FIG. 9. Consequently, the friction of the valve operating system increases. This may degrade fuel efficiency and decrease the wear resistance of the components of the variable valve mechanism 40.

Such being the case, the present embodiment sets the lost most spring maximum load P2max such that the inertia force F2 of the variable valve mechanism 40 exceeds the maximum load P2max at an engine speed N1 (e.g., 6100 rpm) lower than the long-term guaranteed rotation speed N2 as shown in FIG. 8. In other words, the present embodiment permits the contact A between the intake cam 16 and cam roller 52 to break at the engine speed N1. It thus follows that the intake valve 14 is allowed to jump at an engine speed higher than the engine speed N1.

If the intake valve 14 jumps in the above situation, it might produce an offensive sound when it becomes seated. However, since the rotation speed is high, it appears that the sound produced when the intake valve 14 becomes seated may not cause a serious problem. Further, the jump causes the valve lift amount to increase. This increases the amount of air taken into the cylinder. Therefore, the actual compression ratio does not decrease. Unlike the case where the hydraulic lash adjuster 58 pumps up, therefore, the performance of the internal combustion engine 1 will not possibly deteriorate even if the contact A between the intake cam 16 and cam roller 52 are allowed to break as above.

Further, the present embodiment sets the maximum load P2max such that a bounce occurs at the maximum permissible instantaneous rotation speed Nmax. More specifically, the present embodiment sets the maximum load P2max such that the sum F of the two inertia forces F1 and F2 is greater than the sum P of the two maximum loads P1max and P2max by the predetermined value AF at the maximum permissible instantaneous rotation speed Nmax.

As described above, the present embodiment sets the maximum load P1max on the valve spring 14*b* so as to inhibit the contact B between the rocker roller 57 and oscillation arm 50 from breaking until the long-term guaranteed rotation speed N2 is reached. This inhibits the contact C between the rocker arm 56 and hydraulic lash adjuster 58 from breaking and the hydraulic lash adjuster 58 from pumping up until the long-term guaranteed rotation speed N2 is reached. Therefore, a closing failure of the intake valve 14 is avoided up to the long-term guaranteed rotation speed N2. As a result, it is possible to prevent the performance of the internal combustion engine 1 from deteriorating.

Further, the present embodiment permits the contact A between the intake cam 16 and cam roller 52 to break before allowing the contact B between the rocker roller 57 and oscillation arm to break. This makes it possible to inhibit the hydraulic lash adjuster 58 from pumping up while permitting the intake valve 14 to jump. In addition, since the contact A is allowed to break before the contact B, the maximum load P2max on the lost motion spring 55 can be reduced. Therefore, the maximum load P2max on the lost motion spring 55 is set low to permit the breaking of contact A even when the maximum load P1max on the valve spring 14*b* is set as described above. Thus, an unnecessary friction increase in the variable valve mechanism 40 can be suppressed. This makes it possible to suppress a deterioration of fuel efficiency and a decrease in the wear resistance of components of the variable valve mechanism 40.

Moreover, the present embodiment sets the maximum loads P1max and P2max such that the engine speed at which a bounce occurs is the maximum permissible instantaneous rotation speed Nmax. Therefore, an unnecessary friction increase in the variable valve mechanism 40 can be suppressed as compared with a case where the engine speed at which a bounce occurs is higher than the maximum permissible instantaneous rotation speed Nmax.

The present embodiment allows a bounce to occur at the maximum permissible instantaneous rotation speed Nmax. However, the engine speed at which a bounce occurs is not limited to the maximum permissible instantaneous rotation speed Nmax. When the critical engine speed at which the inertia force F2 exceeds the lost motion spring maximum load P2max is set lower than the critical engine speed at which the inertia force F1 exceeds the valve spring maximum load P1max, the engine speed at which a bounce occurs can be lower than the engine speed N3 in the comparative example shown in FIG. 9. Therefore, it is possible to suppress an unnecessary friction increase.

Further, if it is possible to eliminate the possibility of the impact of a bounce degrading reliability, a bounce may be allowed to occur at a rotation speed lower than the maximum permissible instantaneous rotation speed Nmax. In this instance, the lost motion spring maximum load P2max can be made lower than when a bounce is allowed to occur at the maximum permissible instantaneous rotation speed Nmax. Therefore, an unnecessary friction increase can be further suppressed.

In the present embodiment, the intake cam 16 corresponds to the "drive cam" according to the first aspect of the present invention; the hydraulic lash adjuster 58 corresponds to the "hydraulic lash adjuster" according to the first aspect of the present invention; the intake valve 14 corresponds to the "valve" according to the first aspect of the present invention; and the rocker arm 56 corresponds to the "rocker arm" according to the first aspect of the present invention. Further, in the present embodiment, the variable valve mechanism 40 corresponds to the "variable valve mechanism" according to the first aspect of the present invention; the internal combustion engine 1 corresponds to the "internal combustion engine" according to the first aspect of the present invention;

the lost motion spring 55 corresponds to the "lost motion spring" according to the first aspect of the present invention; and the valve spring 14*b* corresponds to the "valve spring" according to the first aspect of the present invention.

The invention claimed is:

1. An internal combustion engine with a mechanical variable valve mechanism that is positioned between a drive cam and a rocker arm, which is supported by a hydraulic lash adjuster and a valve, the internal combustion engine comprising:

a lost motion spring which imposes a load so as to press the variable valve mechanism against the drive cam; and a valve spring which imposes a load so as to press the rocker arm against the variable valve mechanism;

wherein, when a first engine speed is a critical engine speed at which the inertia force of the variable valve mechanism exceeds the maximum load on the lost motion spring and a second engine speed is a critical engine speed at which the inertia forces of the valve and the rocker arm exceed the maximum load on the valve spring, the maximum loads of the lost motion spring and the valve spring are set such that the first engine speed is lower than the second engine speed.

2. The internal combustion engine with a mechanical variable valve mechanism according to claim 1, wherein the maximum loads on the lost motion spring and the valve spring are set such that an engine speed at which the valve bounces is a maximum permissible instantaneous rotation speed, which is the instantaneously permissible maximum engine speed.

3. The internal combustion engine with a mechanical variable valve mechanism according to claim 1, wherein the maximum load on the valve spring is set such that the second engine speed is a long-term guaranteed rotation speed, which represents the maximum rotation speed that can be achieved by the internal combustion engine alone after a fuel cut.

4. The internal combustion engine with a mechanical variable valve mechanism according to claim 2, wherein the maximum load on the valve spring is set such that the second engine speed is a long-term guaranteed rotation speed, which represents the maximum rotation speed that can be achieved by the internal combustion engine alone after a fuel cut.

* * * * *